United States Patent [19]

Kerr

[11] Patent Number: 5,033,704

[45] Date of Patent: Jul. 23, 1991

[54] PAINT BRUSH HOLDING ACCESSORY FOR USE ON AN OPEN-MOUTHED PAINT CONTAINER

[76] Inventor: Edward E. Kerr, 484 Jefferson St., Norristown, Pa. 19401

[21] Appl. No.: 570,918

[22] Filed: Aug. 22, 1990

[51] Int. Cl.[5] ..... A46B 17/02

[52] U.S. Cl. ..... 248/110; 220/90; 248/206.5; 248/213.2

[58] Field of Search ..... 248/110, 111, 112, 113, 248/309.4, 206.5, 213.2; 211/65, 66, DIG. 1; 220/90; 15/257 R

[56] References Cited

U.S. PATENT DOCUMENTS

| | | | |
|---|---|---|---|
| 2,344,256 | 7/1958 | Campbell . | |
| 2,436,924 | 3/1948 | Hansen | 211/65 |
| 2,639,835 | 5/1953 | Nelson | 248/110 X |
| 2,748,977 | 6/1956 | Sarchet | 248/110 X |
| 3,536,285 | 10/1970 | Vaughn | 211/65 X |
| 3,948,413 | 4/1976 | Gorrell | 220/90 |
| 4,101,046 | 7/1978 | Puntillo | 248/110 X |
| 4,266,686 | 5/1981 | Carter | 220/90 |
| 4,377,239 | 3/1983 | Jimae | 211/65 |
| 4,746,089 | 5/1988 | Clapper | 248/309.4 |
| 4,844,281 | 7/1989 | Bradford | 220/90 |

*Primary Examiner*—J. Franklin Foss
*Attorney, Agent, or Firm*—Terry M. Gernstein

[57] ABSTRACT

A monolithic one-piece body is releasably attached to a groove surrounding an open mouth of a paint container and has a top shelf that extends over that open mouth. A magnet is located in the top shelf and magnetically affixes a paint brush bristle ring to the top shelf in a manner which locates the paint brush bristles over the paint container open mouth. The top shelf can be parallel to a plane containing the open mouth, or can be tilted, and various magnet elements are used and are spaced at various locations to accommodate plural brushes or to locate brushes at various locations on the top shelf. The magnets are also located to automatically attract the brush to the desired location even if a painter is not watching where the brush is being placed on the top shelf.

5 Claims, 3 Drawing Sheets

PAINT BRUSH HOLDING ACCESSORY FOR USE ON AN OPEN-MOUTHED PAINT CONTAINER

TECHNICAL FIELD OF THE INVENTION

The present invention relates to the general art of containers, and to the particular field of accessories for containers.

BACKGROUND OF THE INVENTION

The construction industry has long included painting as part of the finish work of a job. This finish work is often performed by professional painters; however, many "do-it-yourselfers" also carry out painting jobs on their own homes and buildings.

While many people enjoy painting, one of the more distracting occurrences of a painting job is the dripping of a paint brush when such brush is not in use. For example, if the painter places the brush on top of a paint can so he can perform other tasks, the brush has a tendency to drip down the sides of the paint can. The drips can be a problem if they fall onto a finished floor, and can cause the paint can to be difficult to re-close if they fall into the cap-receiving and locking groove on that paint can. While newspaper and drop cloths can be used to protect the floor, such items can become messy and burdensome to use, and do not fully protect the paint container itself. Furthermore, while paint can be scraped out of the paint can groove, this protection is often not effected, and the paint can is not tightly resealed and paint may tend to dry out during storage. It is also noted that permitting paint to drip from a brush onto either the can or onto a support surface can be wasteful of paint as well as wasteful of time necessary to clean up the paint thus dripped.

Furthermore, resting a paint brush on top of a paint can is also precarious since the brush often falls either into the paint can or onto the surface beneath or adjacent to the can. This is quite undesirable since it is wasteful of both paint and the time required to clean up the paint that splatters off of the brush when it falls onto the surrounding surfaces, or to clean the handle of the brush if it falls into the paint can. Still further, simply resting the brush on top of a paint can may cause some of the paint from the brush to fall out of the paint can. Even if most of the paint does, in fact, fall back into the paint can, some of the paint falling out of the can may create problems. Properly balancing the brush on the paint can may require more attention than a painter wishes to devote to this simple task, and the balance may not always be what it should be.

While the art has included devices for removing excess paint from paint brushes, and while these devices have been somewhat successful in some instances, such devices can be expensive and time consuming to use. For this reason, many painters do not use them. some of these device also tend to waste paint, and can be difficult to clean thereby increasing their costs due to the time required to clean them.

Therefore, there is a need for a device which can be used in conjunction with a paint container to prevent paint from paint brush that is temporarily out of use from splattering onto a surface beneath or adjacent to the paint can or from dripping onto the can, yet which will be simple and convenient to use and clean and which will be inexpensive to purchase, yet which will securely support a paint brush in position to reliably and efficiently direct any paint from that brush back into the paint can.

OBJECTS OF THE INVENTION

It is a main object of the present invention is to provide a device which can be used in conjunction with a paint can to prevent paint from paint brush that is temporarily out of use from splattering onto a surface beneath or adjacent to the paint can.

It is another object of the present invention to provide a device which can be used in conjunction with a paint can to prevent paint from paint brush that is temporarily out of use from splattering onto a surface beneath or adjacent to the paint can or from dripping onto the can.

It is another object of the present invention to provide a device which can be used in conjunction with a paint can to prevent paint from paint brush that is temporarily out of use from splattering onto a surface beneath or adjacent to the paint can or from dripping onto the paint can itself, yet which will be simple and convenient to use and clean.

It is another object of the present invention to provide a device which can be used in conjunction with a paint can to prevent paint from paint brush that is temporarily out of use from splattering onto a surface beneath or adjacent to the paint can or from dripping onto the paint can itself, yet which will be simple and convenient to use and clean and which will be inexpensive to purchase.

It is another object of the present invention to provide a device which can be used in conjunction with a paint can to prevent paint from paint brush that is temporarily out of use from splattering onto a surface beneath or adjacent to the paint can or from dripping onto the paint can itself, yet which will be simple and convenient to use and clean and which will be inexpensive to purchase, yet which will securely support a paint brush in position to reliably direct any paint from that brush back into the paint can.

It is another object of the present invention to provide a device which can be used in conjunction with a paint can to prevent paint from paint brush that is temporarily out of use from splattering onto a surface beneath or adjacent to the paint can or from dripping onto the can and which can tilt the brush so gravity assists in the cleaning of the brush and will still hold the brush in a secure manner.

SUMMARY OF THE INVENTION

These, and other, objects are achieved by a paint brush holding device that is inserted into the cap locking groove on a paint can and which supports a paint brush over the open mouth of such paint can. The accessory is monolithic and one-piece so it is easy and inexpensive to manufacture and easy to clean.

The accessory includes a base which is easily snapped into and out of engagement with the paint can top locking groove and a top shelf which extends out over the open mouth of the paint can when the base is engaged with the locking groove. A magnet is located on the top shelf and magnetically attracts a metal ring that is located on nearly all paint brushes. This metal ring is used to secure the brush bristles to the brush frame, and is located to position the bristles directly over the open mouth when the brush metal ring is magnetically mounted to the top shelf by the magnet.

The magnet can include a single or multiple magnets mounted on the top shelf, or can include magnetic elements, such as magnetic spheres, embedded in the top shelf material, or the top shelf itself can be magnetized, as by being formed of magnetized metal. The top shelf can also be parallel to a plane containing the container open mouth so a brush will be securely held and will not be likely to slide off of the top shelf, either towards the paint container open mouth or towards the outer wall of the paint container, or the top shelf can be slightly tilted towards the open mouth whereby gravity is used to assist the paint to drip off of the bristles and into the container.

The accessory is also curved on a curvature which matches the curvature of the cylindrical paint container. This matching of curves permits the device to be placed around the paint can for storage. In fact, the accessory can be packaged with the paint can and sold with the paint as a single unit.

Using this accessory, the brush will be securely held and reliably positioned to have the bristles thereof located so that any paint dripping off of those bristles will fall through the paint can open mouth and directly back into the paint can. The brush will be securely held and will not need to be balanced by the user so the accessory is easy to use, yet the brush is not likely to fall off of or into the paint can, and the paint can be efficiently removed from the paint brush.

BRIEF DESCRIPTION OF THE DRAWING FIGURES

DETAILED DESCRIPTION OF THE PREFERRED EMBODIMENT OF THE INVENTION

Figure 1:
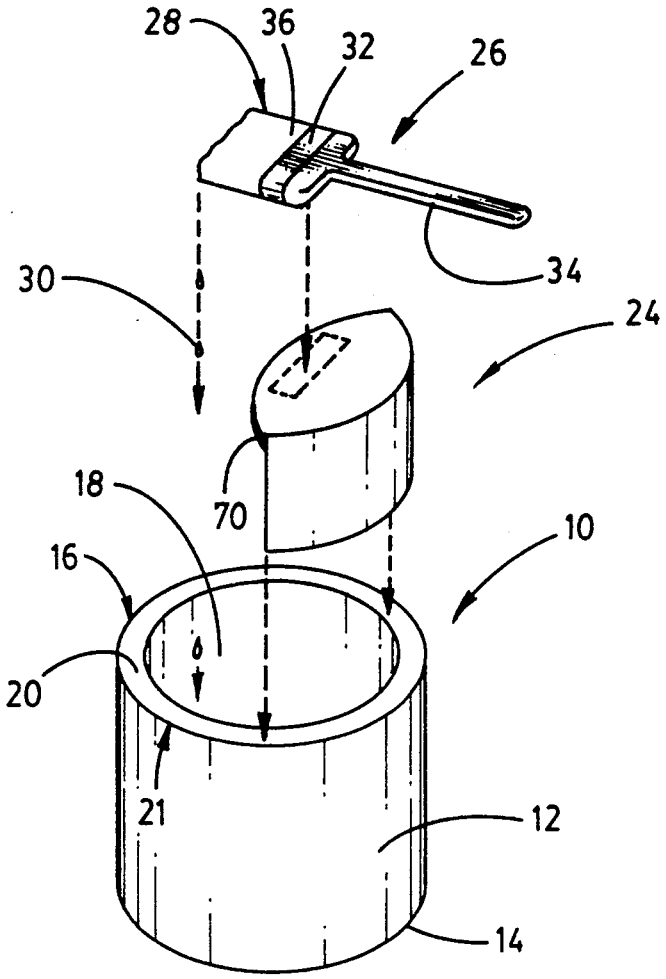
FIG. 1 is an exploded perspective view of the accessory embodying the present invention in conjunction with an open paint can having a can top locking groove thereon in surrounding relationship with an open mouth of the paint can.

Shown in FIG. 1 is a paint container or can 10 having a cylindrical wall 12 connecting a bottom 14 to a top 16. The top 16 includes a mouth section 18 which is open when a can cover (not shown) is removed from covering relation with the paint can. The can includes a locking groove 20 which is defined in the upper rim 21 of the container and which circumnavigates the can top to completely surround the open mouth, and the can cover is releasably attached to this groove to releasably lock that cover to the can. Suitable can handles, a bail (not shown) or the like may also be included on the paint can, and this paint container may be any suitable size as is well known to those skilled in the art.

The present invention is embodied in an accessory 24 which is releasably mounted on the paint can 10 via the locking groove 20 to hold a paint brush 26 in position so that the bristles 28 of the paint brush are positioned directly above the open mouth 18 of the paint can whereby any paint drops 30 falling off of these bristles will fall directly through the can open mouth 18 and back into the can without dropping onto the outer surfaces of the paint can or onto any surfaces that are located adjacent to the paint can, such as a support surface or the like.

The inventor observed that most paint brushes include a metal locking ring 32 surrounding the bristles 28 and attaching those bristles to a paint brush frame 34. The inventor has also observed that this metal ring is located near the proximal end of the bristles. Therefore, the accessory 24 is designed to hold the brush at the metal ring 32 in cantilever fashion with the bristles extending out over the open mouth of the paint can in a manner that leaves the bristles supported only near the proximal end 36 thereof whereby the body of the bristles will be free of supporting surfaces and any paint on such bristles will fall into the paint can in a manner that is unimpeded by any structure either of the paint can or of the supporting accessory. In this manner, the paint will fall into the can and not onto any structure that may have to be cleaned.

Since the bristle ring 32 is generally metal, the accessory 24 uses magnetic attraction to releasably fix the brush 26 thereto. This magnetic attraction is effected by either magnetizing the accessory itself, in which case the accessory is held to the paint can in a more secure manner since the paint can itself is metal and this magnetic attraction will assist in the mounting of the accessory to the metal paint can adjacent to the groove 20, or by making only that portion of the accessory which will contact the paint brush magnetic, or by embedding a magnet in that portion of the accessory which will contact the brush, or by mounting a magnet on that portion of the accessory which will contact the brush in which case the magnet can be moved to position a paint brush in the most desirable location, and will permit the magnet to be changed as necessary without requiring the change of the entire accessory.

Figure 4:
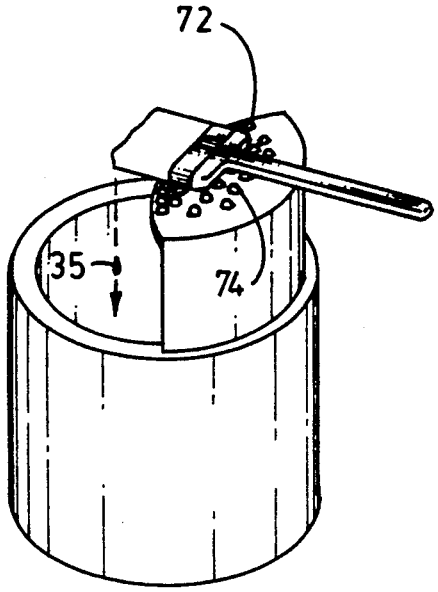
FIG. 4 is an assembled perspective view of the accessory in conjunction with a paint can.
Figure 2:
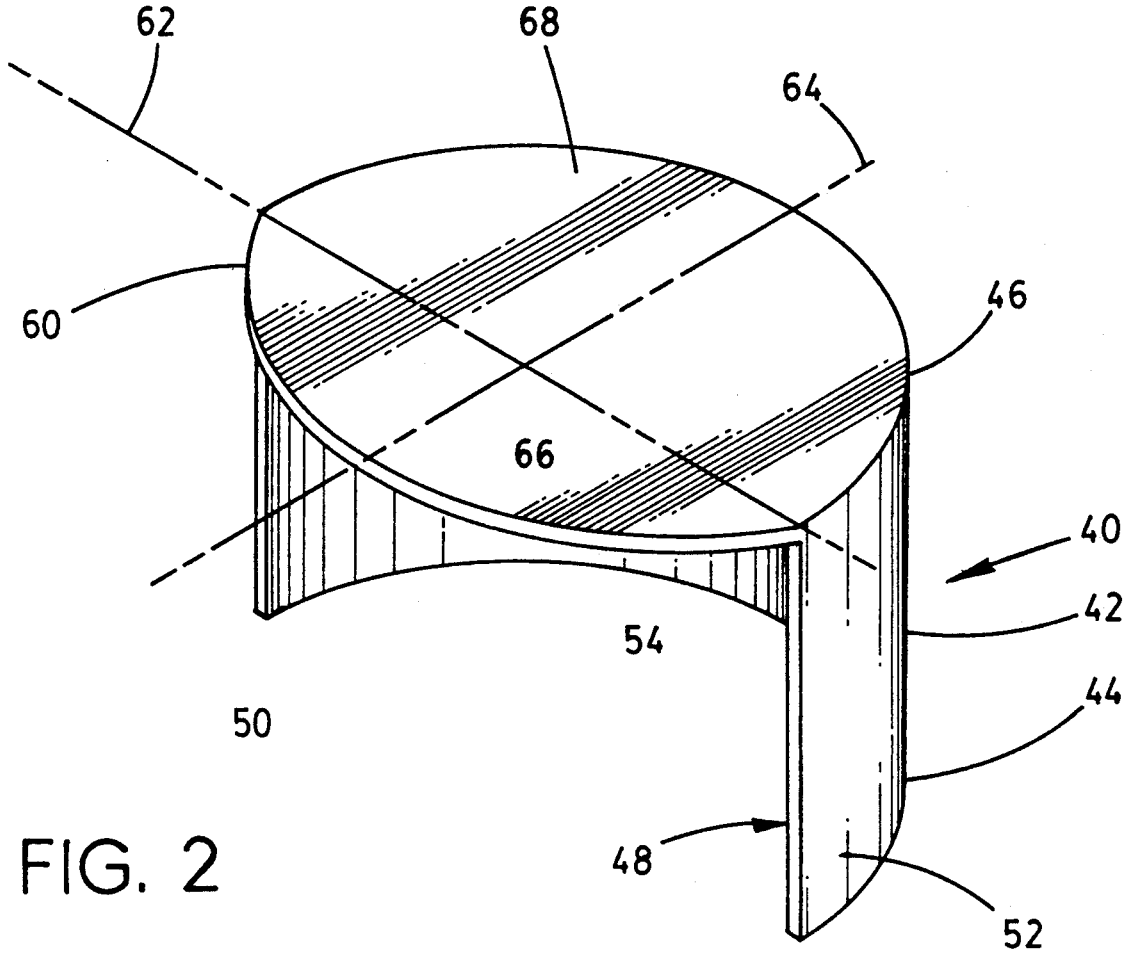
FIG. 2 is a top and front perspective view of the paint brush holding accessory of the present invention.

Referring to FIGS. 2 et seq, a more specific description of the accessory will now be presented. As shown in FIG. 2, the accessory 24 includes a monolithic, one-piece body 40 which includes a base section 42 which has a proximal end 44 that engages the paint can groove 20 when the accessory is in position on that container as shown in FIG. 4, and a distal end 46 which is spaced above the paint can open mouth when the accessory is in the FIG. 4 mounted condition. The base section further includes two sides 48 and 50 which connect the distal end to the proximal end and which extend upwardly above the open mouth of the paint can in the mounted condition of the accessory.

The base section is curved to roughly match the curvature of the paint can 12 whereby the base proximal end will snugly fit into the groove 20 and be securely, yet releasably, held therein. Different base sections can be provided to accommodate different paint cans as will occur to those skilled in the art. The base section has an outer surface 52 and an inner surface 54 and a thickness as measured between the inner surface and the outer surface which slightly exceeds the width of the groove 20 to create a friction fit between the base and the paint can.

The accessory further includes a top shelf 60 which is located on the distal end of the base section and extends from that distal end radially inward of the curved base section. The top shelf is planar and is oval in outer peripheral shape to have a major axis 62 extending along a secant of the circular paint can mouth, and a minor axis 64 which extends along a radius of such circular mouth and inwardly from the base section. The major axis intersects the base section sides 48 and 50 and the minor axis is located midway between those sides 48 and 50. The top shelf includes an undersurface 66 which is located adjacent to the base section inner surface 54 and a top surface 68 which is located adjacent to the base section outer surface 52. The top shelf has a thickness as measured between the top surface 68 and the undersurface 66 that matches the thickness of the base section. The top shelf includes a distal end 70 that connects the base sides 48 and 50 together. This distal end 70 has a curvature that is equal to the curvature of the base section whereby the top shelf extends out over the open mouth of the paint can when the accessory is mounted on that paint can in the groove 20.

As shown in FIG. 4, the top shelf is located on the base section to extend out over the open mouth of the paint can when the accessory is mounted on that paint can via the paint can groove. The accessory supports a paint brush 26 in position to have the bristles 28 thereof located directly above the open mouth of the paint can as shown in FIG. 4 whereby paint from those bristles will fall directly into the paint can and is not likely to contact either the paint can, or the accessory and is not likely to fall out of the paint can and contact any surfaces located adjacent to the paint can.

One form of the accessory is metallic and is magnetized whereby the base section is magnetically attracted to the metal paint can adjacent to the groove 20 and the top shelf is magnetically attracted to the metal ring 32 of the paint brush. The metal ring can be located as close to the top shelf distal end 70 as desired and can be located immediately interadjacent thereto if it is desired to ensure that all of the bristles will be located only above the open mouth of the paint can and will not be in position to drip paint onto the accessory. The magnetic attraction of the top shelf is adjusted so that such cantilever support of a wet paint brush can be effected with the ring directly and immediately adjacent to the top shelf distal end 70.

Figure 5:
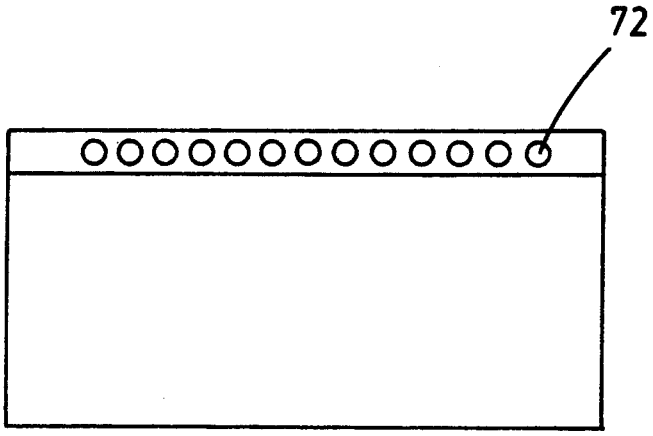
FIG. 5 is a front elevational view of the accessory showing magnetic spheres located in a top shelf section thereof.
Figure 6:
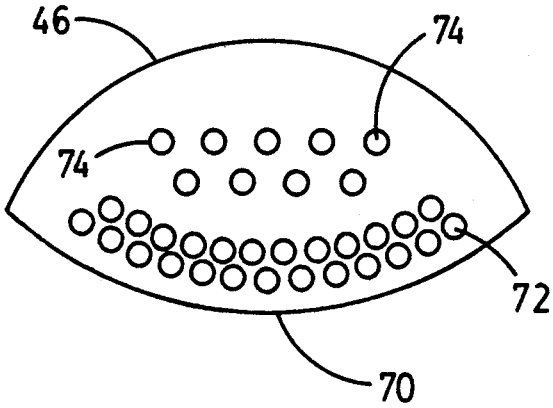
FIG. 6 is a top plan view of the accessory showing a clustered formation of the magnetic spheres.

Another form of the accessory includes magnetic particles embedded in the top shelf with the accessory being formed of plastics-type material. Such embedded magnetic particles are indicated in FIGS. 4, 5 and 6 as magnetic metal spheres 72. These spheres are clustered near the top shelf distal end 70 as indicated in FIGS. 4 and 6. By having the magnetic attraction strongest near the top shelf distal end, the brush is automatically guided toward the desired position with all of the bristles located over the can open mouth. The just-discussed form of the accessory can also include a magnetic field adjusted to exert the strongest attraction of a paint brush metal ring near the top shelf distal end 70. However, some spheres 74 are also located near the base section distal end 46 whereby a paint brush can be supported to have the bristles thereof extending near that base section if so desired. The spheres can be clustered to support more than one brush on the top shelf in various locations and to attract those several brushes to desired locations, such as near the top shelf distal end, or the like. For example, a cluster of densely spaced magnets can be located closely adjacent to the distal edge 70 so a paint brush will be automatically guided to a location which orients the bristle thereof directly over the container open mouth 18 even if the painter sets the brush down without looking where he is placing that brush.

Figure 3:
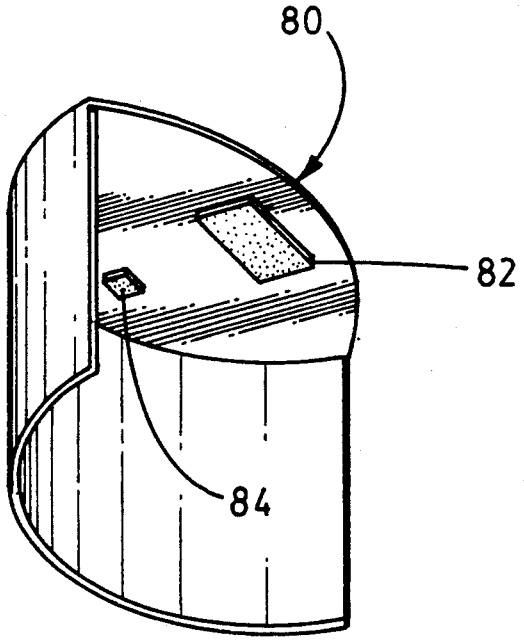
FIG. 3 is a bottom perspective view of the paint brush holding accessory of the present invention showing a magnet on the undersurface of a top shelf of the accessory.

Yet another form of the accessory is shown in FIG. 3 as accessory 80. The accessory 80 is formed of a plastic body and includes a magnet 82 fixed to the undersurface 66 of the top shelf. The magnet can be adhesively mounted to the top shelf, or the top shelf can be formed of metal whereby the magnet will be fixed thereto by magnetic attraction. The magnet 82 is strong enough to attach the paint brush metal ring to the top shelf while exerting its magnetic attraction through the top shelf. The magnet 82 can be located anywhere on the top shelf so the brush can be supported in any position on that top shelf, either immediately adjacent to the top shelf distal end 70, or near the base section distal end 46 or somewhere intermediate to such positions as desired. More than one magnet can be included if desired as indicated by magnet 84 located adjacent to the base section distal end 46, to support more than one brush, to more strongly attract a brush to the top shelf, to more strongly attract a brush to one particular location on the top shelf, or the like.

The top shelf can be sized as shown in FIG. 4 so the brush handle is located within the perimeter of the top shelf when the brush is in the desired position on that top shelf, or the top shelf can be sized to have the brush handle extend out of the perimeter of the top shelf when the bristle ring is located immediately interadjacent to the top shelf distal end.

Figure 7:
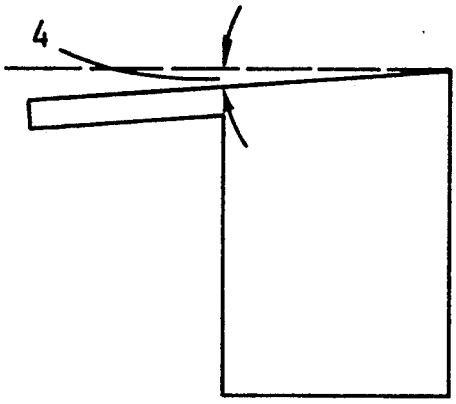
FIG. 7 is a side elevational view of the accessory showing a tilted top shelf section thereof.

In the preferred form of the accessory, the top shelf is planar and is located in a plane which is parallel to a plane containing the paint container open mouth 18 so that a brush will be securely supported in a proper position over that open mouth. Ab alternative form of the accessory includes a top shelf which is slightly tilted toward the open mouth so that paint is biased by gravity to drip off of the bristles into the container open mouth. This tilted top shelf is indicated in FIGS. 4 and 7. The amount of tilt selected for the top shelf is chosen so the brush will be held securely enough to ensure that it will not slide off of the top shelf, yet will be tilted enough to ensure that paint will fall from the brush into the container. A tilt angle alpha shown in FIG. 7 between a horizontal line and the top surface of the top shelf of less than ten degrees with respect to the horizontal has been found ideal for achieving both of these results.

It is understood that while certain forms of the present invention have been illustrated and described herein, it is not to be limited to the specific forms or arrangements of parts described and shown.

What is claimed is:

1. An accessory for supporting a paint brush in position above an open mouth of a paint can comprising:

a monolithic, one-piece body which is adapted to be releasably attached to a paint container having a cylindrical wall with a bottom and a top and a circular open mouth defined in the top, the paint container further including a circular upper rim and an arcuate groove defined in that upper rim, the groove and the upper rim arcuately surrounding the open mouth with the groove being adapted to have a container cover releasably mounted therein for releasably attaching that cover to the container in covering and closing relationship to the container open mouth, said body including a base section having a proximal end, a distal end, and two side ends connecting said proximal end to said distal end, said base section being curved between said two ends to match the curve of the paint container grooved top rim and having an inner surface which is located adjacent to the container open mouth when said body is attached to the paint container and an outer surface with a thickness as measured between said inner and outer surfaces which slightly exceeds the width of the paint container groove so that the body is frictionally held in a snug manner in that groove, said body extending upwardly from the paint container top with the proximal end thereof from the paint container top with the proximal end thereof received in the groove and the distal end thereof spaced from the paint container top end when the body is attached to the paint container, said body further including a top shelf section on said base section distal end, said top shelf section extending from said base section distal end out over the paint container open mouth when said body is attached to the paint container at the paint container groove, said top shelf section being oval in peripheral shape and having a major axis which intersects said base section two sides and which extends along a secant of the paint container circular mouth when the body is attached to the paint container, and a minor axis which extends from said base section distal end on a radius of the paint container circular mouth when the body is attached to the paint container, said top shelf section further including an upper surface located adjacent to said base section outer surface and an undersurface located adjacent to said base section inner surface, said top shelf section further including a curved distal edge connecting said base section two sides together and extending outwardly from said two sides so that said top shelf section overlaps and overlies the paint container open mouth when said base section is attached to the paint container, and said body further including magnetic means in said top shelf, said magnetic means including a first plurality of magnetic spheres embedded in said top shelf section and clustered near said top shelf section distal edge and a second plurality of magnetic spheres embedded in said top shelf section near said base section distal end, said first plurality of magnetic spheres located adjacent to said top shelf distal edge being spaced closer to each other than are the spheres in said second plurality of magnetic spheres located adjacent to said base distal end.

2. The accessory defined in claim 1 wherein said top shelf is planar and is located in a plane which is parallel to a plane containing the paint container open mouth.

3. The accessory defined in claim 1, wherein said top shelf is planar and is located in a plane which is tilted with respect to a plane containing the paint container open mouth.

4. The accessory defined in claim 3 wherein said top shelf is tilted at an angle which is less than ten degrees with respect to horizontal.

5. An accessory for supporting a paint brush in position above an open mouth of a paint can comprising:

a monolithic, one-piece body which is adapted to be releasably attached to a paint container having a cylindrical wall with a bottom and a top and a circular open mouth defined in the top, the paint container further including a circular upper rim and an arcuate groove defined in that upper rim, the groove and the upper rim arcuately surrounding the open mouth with the groove being adapted to have a container cover releasably mounted therein for releasably attaching that cover to the container in covering and closing relationship to the container open mouth, said body including a base section having a proximal end, a distal end, and two side ends connecting said proximal end to said distal end, said base section being curved between said two ends to match the curve of the paint container grooved top rim and having an inner surface which is located adjacent to the container open mouth when said body is attached to the paint container and an outer surface with a thickness as measured between said inner and outer surfaces which slightly exceeds the width of the paint container groove so that the body is frictionally held in a snug manner in that groove, said body extending upwardly from the paint container top with the proximal end thereof received in the groove and the distal end thereof spaced from the paint container top end when the body is attached to the paint container, said body further including a top shelf section on said base section distal end, said top shelf section extending from said base section distal end out over the paint container open mouth when said body is attached to the paint container at the paint container groove, said top shelf section being oval in peripheral shape and having a major axis which intersects said base section two sides and which extends along a secant of the paint container circular mouth when the body is attached to the paint container, and a minor axis which extends from said base section distal end on a radius of the paint container circular mouth when the body is attached to the paint container, said top shelf section further including an upper surface located adjacent to said base section outer surface and an undersurface located adjacent to said base section inner surface, said top shelf section further including a curved distal edge connecting said base section two sides together and extending outwardly from said two sides so that said top shelf section overlaps and overlies the paint container open mouth when said base section is attached to the paint container, and said body further including magnetic means in said top shelf, said magnetic means including a first magnet located closely adjacent to said top shelf distal edge, and a second magnet located adjacent to said base section distal end.

* * * * *